US005540439A

United States Patent [19]

Kamentsky

[11] Patent Number: 5,540,439

[45] Date of Patent: Jul. 30, 1996

[54] GAME APPARATUS

[75] Inventor: Howard Kamentsky, Jamaica Plain, Mass.

[73] Assignees: Howard Kamentsky Design, Boston, Mass.; Stephen Schwartz Design, Providence, R.I.

[21] Appl. No.: 522,210

[22] Filed: Aug. 31, 1995

[51] Int. Cl.[6] ..... A63F 3/00

[52] U.S. Cl. ..... 273/241; 273/243; 273/249; 273/282.3; 273/288; 446/441

[58] Field of Search ..... 273/243, 288, 273/241, 248, 249, 282.3; 446/437, 441

[56] References Cited

U.S. PATENT DOCUMENTS

| | | | |
|---|---|---|---|
| 1,212,942 | 1/1917 | Hart . | |
| 2,606,402 | 8/1952 | Fuches | 446/437 |
| 3,098,652 | 7/1963 | Lee . | |
| 3,841,629 | 10/1974 | Barlow . | |
| 4,206,925 | 6/1980 | Goldfarb et al. | 273/248 |
| 4,225,138 | 9/1980 | Wolf | 273/243 |
| 4,333,655 | 6/1982 | Rudell et al. | 273/249 X |
| 4,345,402 | 8/1982 | Hanson et al. . | |
| 4,852,886 | 8/1989 | Zaruba et al. | 273/249 |
| 5,129,655 | 7/1992 | Gillespie et al. | 273/249 X |

FOREIGN PATENT DOCUMENTS

| | | | |
|---|---|---|---|
| 501992 | 5/1954 | Canada | 446/441 |
| 983761 | 6/1951 | France | 446/441 |
| 464041 | 3/1952 | Italy | 446/441 |

*Primary Examiner*—Paul E. Shapiro
*Attorney, Agent, or Firm*—Kurt R. Benson

[57] ABSTRACT

A game apparatus includes a game board surrounded by a fence, a plurality of pawns which are advanceable along the fence and an action character figure which is moveable on the game board. The action character figure is adapted to randomly move about on the game board surface, and each of the pawns includes an ejectable component which is ejected when the pawn is engaged by the action character figure.

9 Claims, 8 Drawing Sheets

GAME APPARATUS

BACKGROUND AND SUMMARY OF THE INVENTION

The instant invention relates to amusement games and more particularly to a game apparatus for playing an amusing new board game.

Board games have frequently been found to have significant levels of popularity, particularly if they are adapted to incorporate highly amusing game themes. It has also been found that amusing action figures and the like, which are adapted to perform amusing action movements, frequently have high levels of popularity. Still further, it has been found that board games and the like which incorporate amusing action figures frequently have enhanced levels of appeal.

The instant invention provides a highly amusing game apparatus comprising an action figure element which is adapted to perform amusing activities during the course of game play. More specifically, the game apparatus of the instant invention comprises an action figure element which is adapted so that it is randomly movable on a supporting surface to actuate target elements during the course of game play. Still more specifically, the instant invention comprises a game surface, a fence extending around the perimeter of the game surface, a movable action character figure which is randomly movable on the game surface and at least one target element on the fence. The character figure is adapted so that it is randomly engageable with the fence and the target elements thereon, and the target elements are adapted to include ejectable action elements which are automatically ejected upon engagement thereof by the character figure. The character figure preferably comprises a rotatable front caster assembly which includes a pair of drive wheels for moving the character figure on the game surface. The drive wheels are preferably driven through a common shaft with the caster assembly so that when the character figure is energized, either just the drive wheels, just the caster assembly, or both the drive wheels and the caster assembly are rotated, depending on the relative resistances to rotation applied to the drive wheels and/or the caster assembly. Accordingly, when the character figure assembly engages the fence so that the drive wheels are prevented from moving the character figure assembly in a forward direction, the caster assembly is rotated by the drive mechanism to cause the character figure assembly to be redirected away from the fence. As a result, once the character figure assembly is actuated, it randomly engages the fence and target elements causing the ejectable components of the target elements to be ejected from the fence.

While the game apparatus of the instant invention can be effectively incorporated into a variety of different games themes, it has been found that it is particularly effective in a game theme in which the action character figure is embodied in the form of a dog and the target elements are embodied as cats which are perched on the fence surrounding the dog. Accordingly, the apparatus can be effectively utilized in a game in which a simulated dog character figure chases cats which are perched on the fence surrounding the dog's yard, and wherein the cats are ejected from the fence when they are contacted by the dog character figure.

Accordingly, it is a primary object of the instant invention to provide an effective game apparatus wherein an action character figure is randomly moved about on a game surface causing the character figure to come into engagement with target elements on a surrounding fence.

Another object of the invention is to provide a game apparatus wherein a game character figure is engageable with target elements for causing the target elements to be ejected.

A still further object of the instant invention is to provide an action character figure which is adapted to randomly move about within the confines of a surrounding fence.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
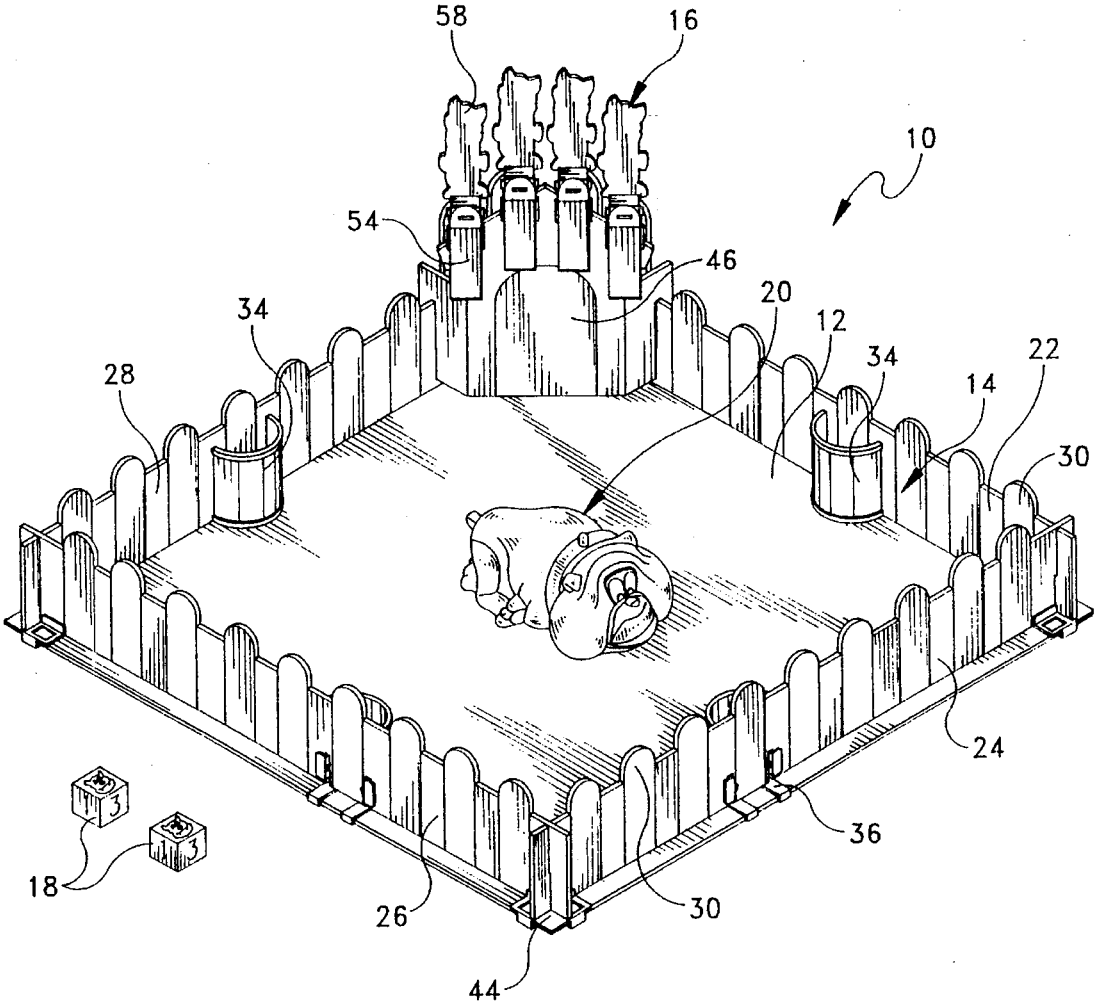
FIG. 1 is a perspective view of the game apparatus of the instant invention.

Referring now to the drawings, the game apparatus of the instant invention is illustrated and generally indicated at 10 in FIG. 1. The game apparatus 10 comprises a game board 12, a fence assembly generally indicated at 14, a plurality of target elements generally indicated at 16, a pair of randomizer dice 18, and an action character figure assembly generally indicated at 20. The game apparatus 10 is adapted for use in a board game format in which game players utilize the target elements 16 as pawns and roll the dice 18 to determine the amounts by which their pawns are advanced along the fence assembly 14 during turns at game play. Further, during random turns at game play, players must actuate the action character figure assembly 20 so that the character figure assembly 20 is randomly moved about on the game board 12 causing it to occasionally randomly engage the target elements 16. The target elements 16 are adapted so that when they are engaged by the character figure assembly 20, portions of the target elements 16 are ejected from the fence assembly 14, whereupon the corresponding game player is penalized in accordance with game rules.

The game board 12 preferably comprises a conventional game board surface, and it is preferably decorated with various designs and/or indicia (not shown) to provide an amusing game surface. The game board 2 as herein embodied is of substantially square configuration, although it will be understood that it can alternatively be embodied in a variety of other configurations.

Figure 2:
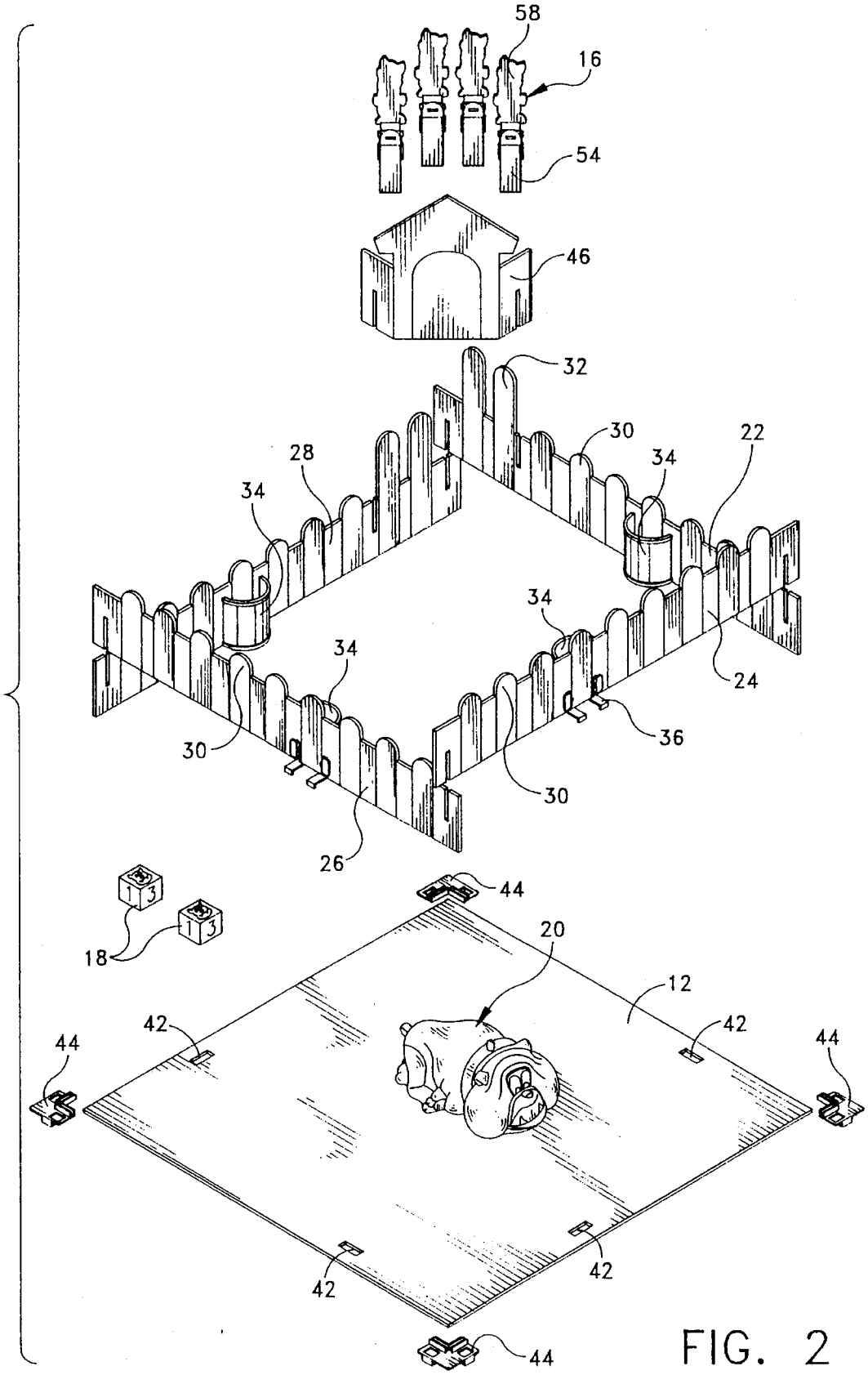
FIG. 2 is an exploded perspective view thereof.
Figure 3:
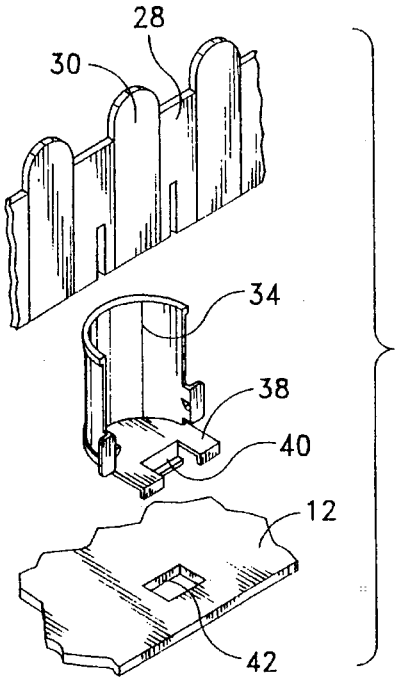
FIG. 3 is an exploded perspective view of a barrel-like enclosure which defines a safe area for a cat perched on the fence.
Figure 4:
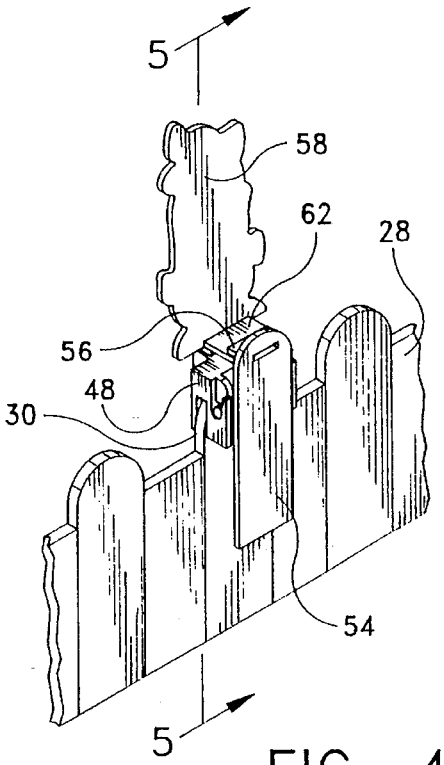
FIG. 4 is a front perspective view of a cat perched on the fence.
Figure 5:
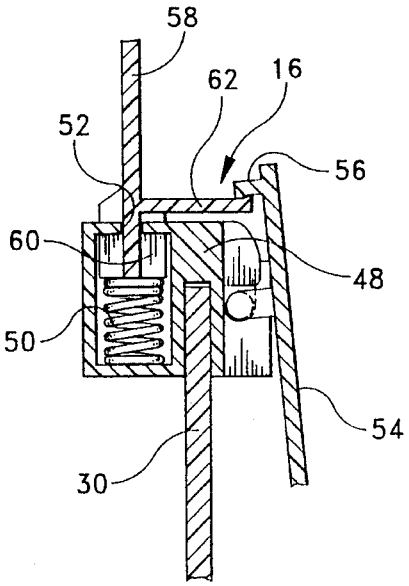
FIG. 5 is a side sectional view taken along the line 5—5 in FIG. 4.
Figure 6:
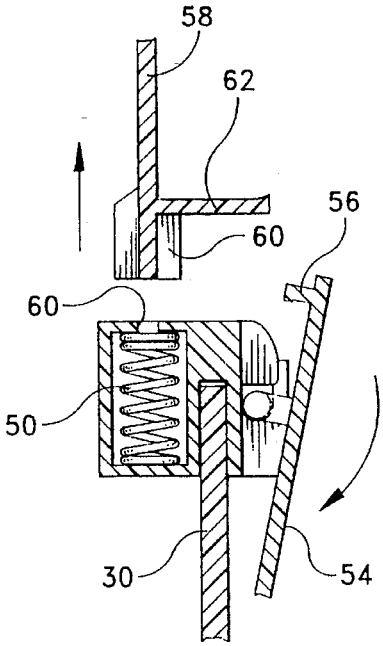
FIG. 6 is a similar view with the cat in an actuated position as it is ejected from the fence.
Figure 7:
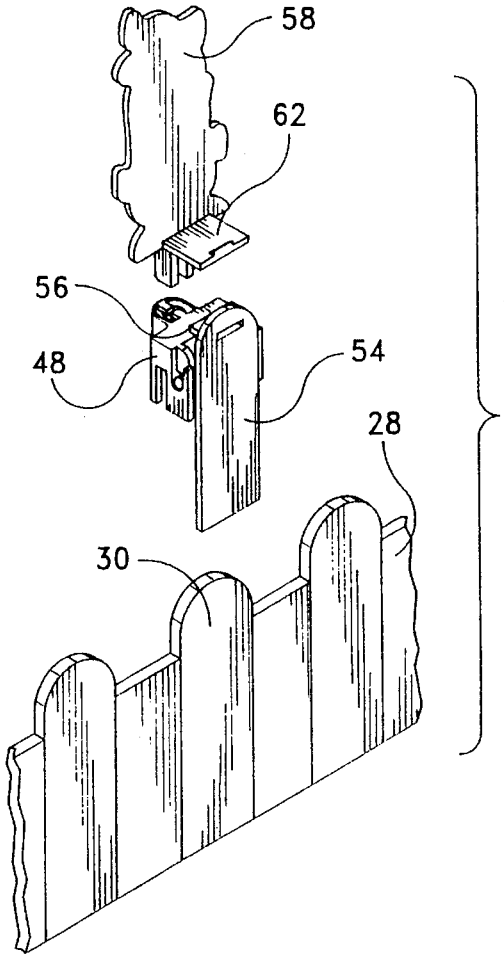
FIG. 7 is an exploded perspective view of a cat and a section of the fence.
Figure 8:
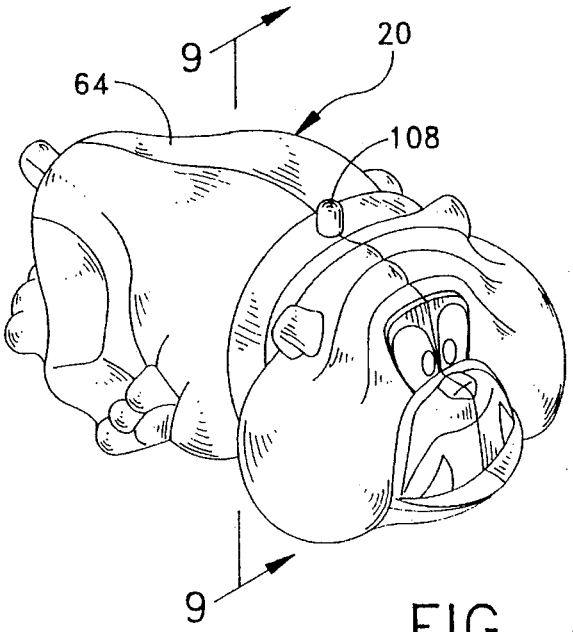
FIG. 8 is a perspective view of the dog character figure.
Figure 9:
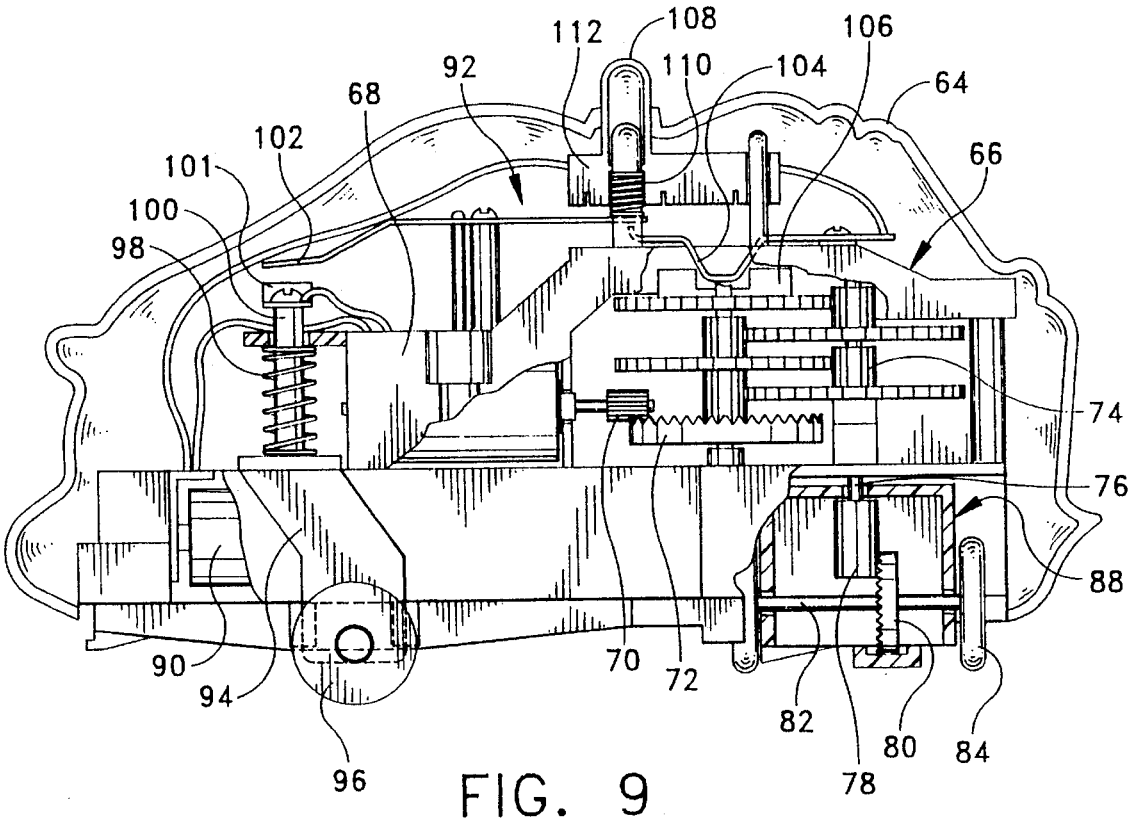
FIG. 9 is a sectional view taken along line 9—9 in FIG. 8 with the drive assembly in an unactuated position.
Figure 10:
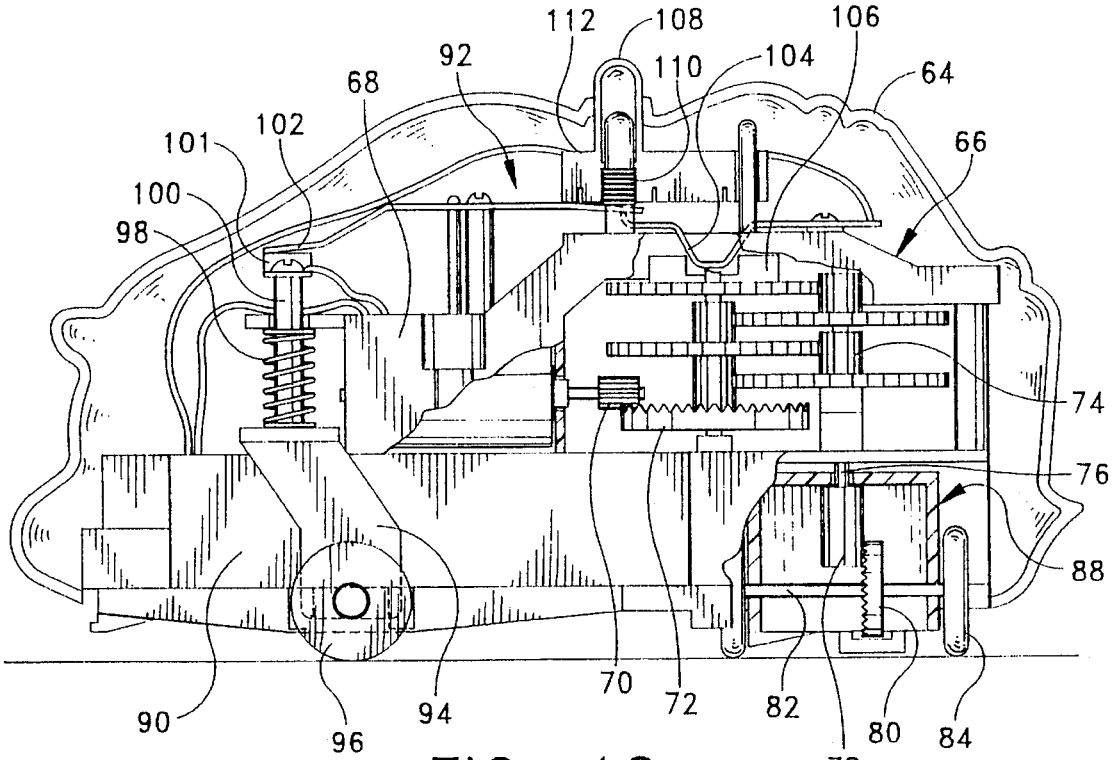
FIG. 10 is a similar sectional view with the drive assembly in an actuated position.
Figure 11:
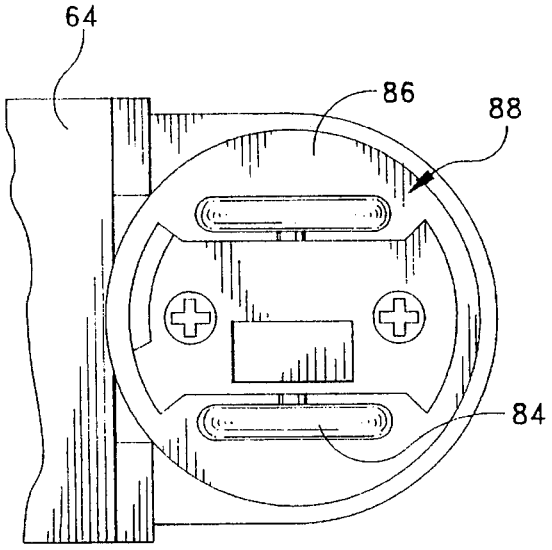
FIG. 11 is a bottom plan view of the front caster assembly.
Figure 12:
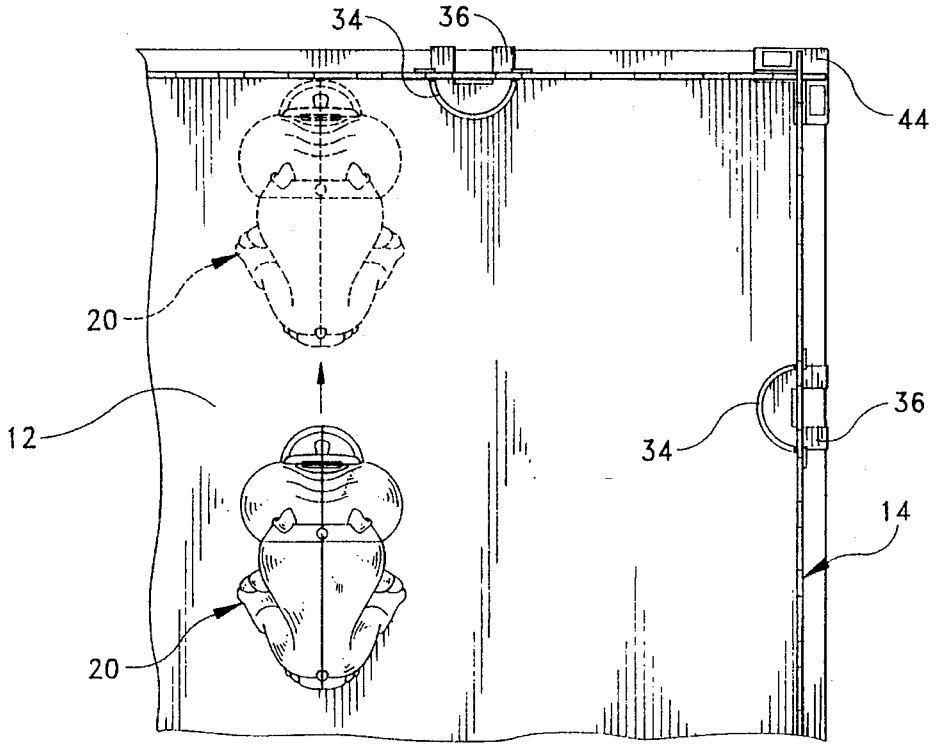
FIGS. 12 and 13 are top plan views illustrating the random operation of the action figure assembly.
Figure 13:
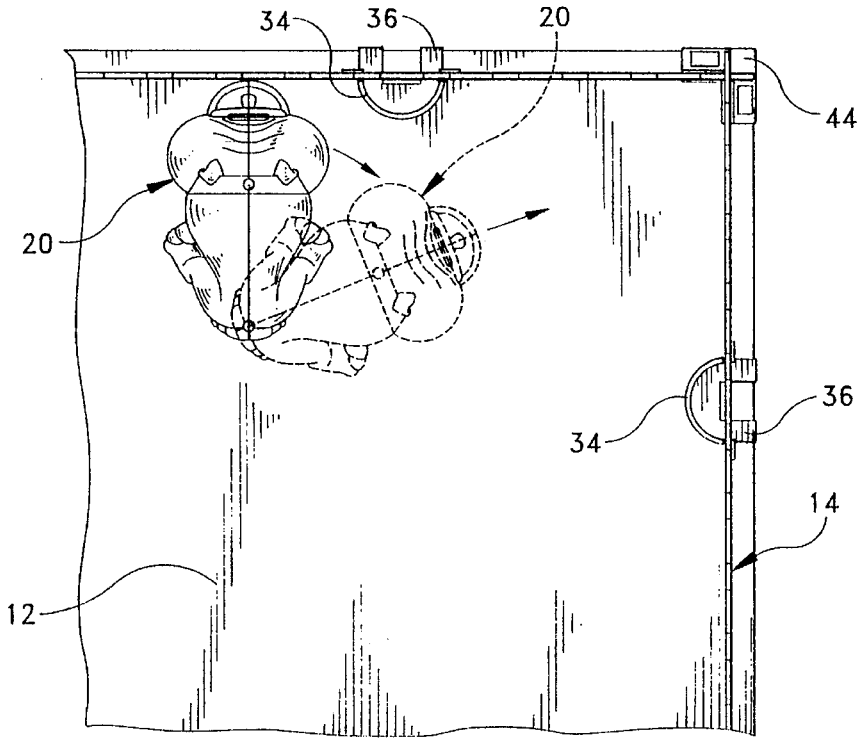
Figure 14:
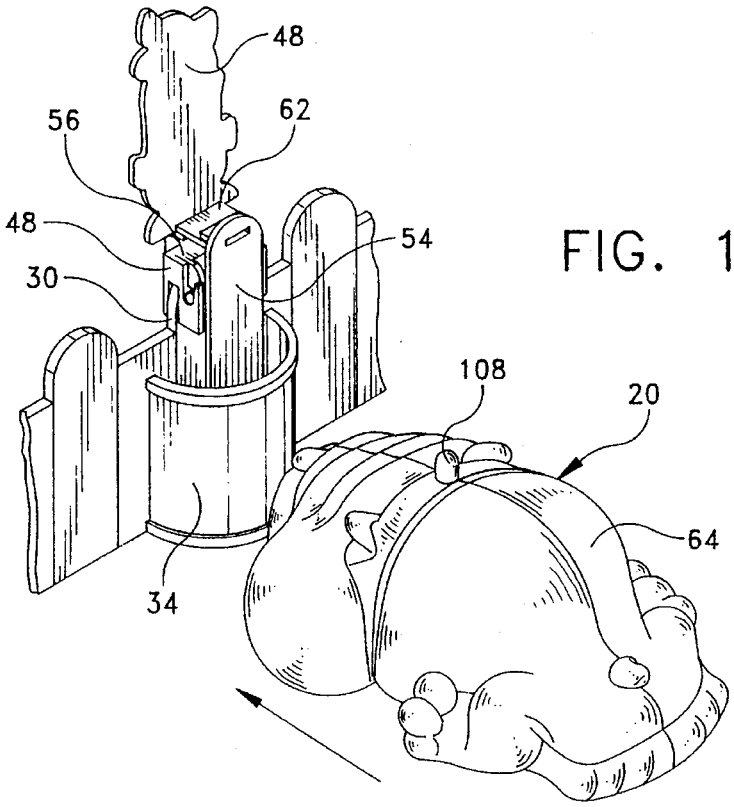
FIG. 14 is a perspective view illustrating the action figure assembly engaging one of the barrel-like enclosures.
Figure 15:
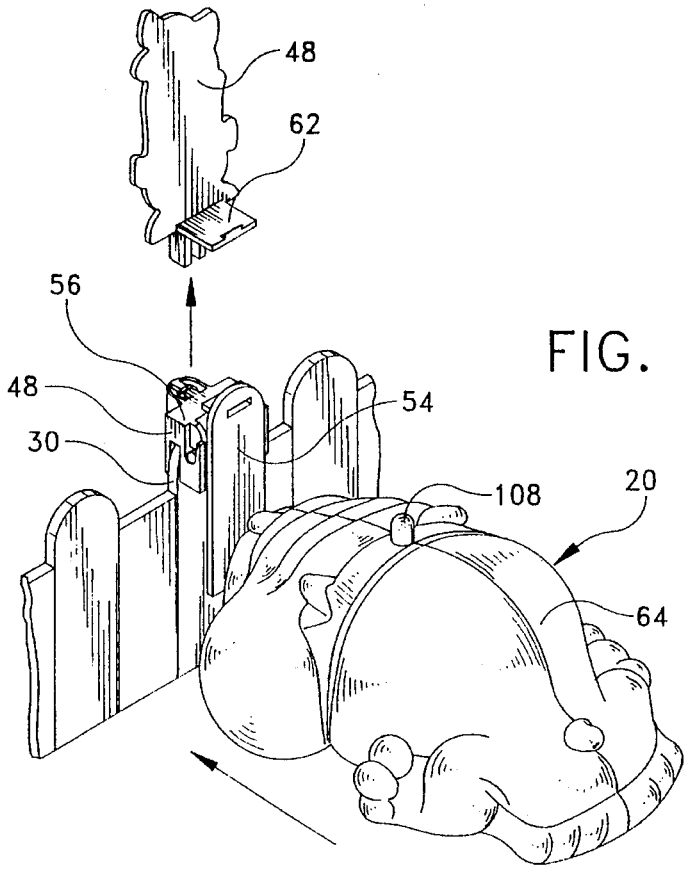
FIG. 15 is a perspective view illustrating the action character figure assembly as it engages one of the target elements.

The fence assembly 14 comprises first, second, third and fourth fence elements 22, 24, 26, and 28, respectively, which have vertically extending slots adjacent opposite ends thereof to enable the fence elements 22, 24, 26, and 28 to be assembled in interfitting relation so that they form a substantially square boundary area for the game board 12. Each of the fence elements 22, 24, 26 and 28 has a plurality of raised pickets 30 along the upper edge thereof, and the first and fourth fence elements 22 and 28 each have a pair of raised posts 32 adjacent one end thereof. Also included in the fence assembly 14 is a plurality of barrel or can assemblies 34 which are attached to the fence elements 22 with brackets 36 so that they define semi-circular upwardly opening trash 'barrel-like structures along the inner side of the fence assembly 14. The brackets 36 are integrally formed with the can elements 34, and they include rearwardly extending arms 38 which are adapted to engage the peripheral edge of the board 12 and downwardly extending tongues 40 which are adapted to be received in apertures 42 in the game board 12. Also included in the fence assembly 14 is a plurality of corner brackets 44 which are receivable in engagement with the fence elements 22, 24, 26 and 28 at the connected ends thereof for retaining the fence assembly 14 in position on the board element 12. In addition, the fence assembly 14 further includes a dog house element 46 which is adapted to be received in engagement on the fence elements 22 and 28 adjacent the connected ends thereof for forming a simulated dog house structure at one corner of the fence assembly 14 as illustrated most clearly in FIGS. 1 and 2.

The construction of the target elements 16 is illustrated most clearly in FIGS. 4–7. As will be seen, each of the target elements 16 include a main body portion 48 which is adapted to be received on the picket elements 30 during the course of game play. Contained in each of the body portions 48 is a coil spring 50, and an opening 52 is provided at the upper end of each of the body portions 48. Each of the target elements 16 further comprises a target arm 54 which is pivotally mounted about a substantially horizontal axis on the respective body portion 48 thereof so that when a target element 16 is received on one of the pickets 30 in the manner illustrated in FIGS. 4–6, the target arm 54 thereof extends downwardly along the inner side of the picket element 30. As illustrated, each of the target arms 54 includes a latch portion 56 which extends inwardly from the upper end thereof. Each of the target assemblies 16 further comprises an ejectable element 58 which is formed in the configuration of an amusing character figure, such as a cat, which appears to be perched on the fence assembly 14 when the target element 16 is received thereon. Each of the ejectable elements 58 includes a downwardly extending base portion 60 and a forwardly extending retaining leg 62. Each of the base portions 60 is receivable in the opening 52 thereof so that the base portion 60 engages the coil spring 50 for biasing the entire ejectable element 58 upwardly. Each of the retaining legs 62 is receivable in engagement with the latch element 56 thereof on the target arm 54 for retaining the ejectable element 58 in the body portion 48 in the manner illustrated in FIG. 5. However, each of the target arms 54 is pivotable inwardly toward the adjacent portion of the fence assembly 14 so that the latch element 56 thereof is disengaged from the retaining leg 62 causing the ejectably element 58 to be ejected upwardly from the body portion 48 in the manner illustrated.

The dice 18 are formed as six-sided cubes having numbers ranging from one to six on four sides thereof and pictures resembling the dog character figure embodied in the character figure element 20 on two sides thereof. Accordingly, the dice 18 can be utilized to randomly determine the number of game spaces a player is entitled to advance his or her target element 16 during a turn at game play and also for randomly determining whether or not the action character figure element 20 should be actuated during that player's turn at game play.

The action character FIG. 20 is illustrated most clearly in FIGS. 8–13. The action character FIG. 20 comprises a split housing 64 containing a drive assembly generally indicated at 66. The drive assembly 66 includes a motor 68 having a pinion gear 70 thereon which drives a crown gear 72 to in turn drive a reduction gear assembly 74. The reduction gear assembly 74 drives an output shaft 76 having a pinion gear 78 thereon which meshes with a crown gear 80 for rotating a drive axle 82 having a pair of drive wheels 84 thereon. The drive wheels 84, the axle 82, and the crown gear 80 are mounted in a front caster housing 86 which is rotatably mounted about the shaft 76. Accordingly, the caster housing 86, the drive wheels 84, the drive axle 82, and the crown gear 80 cooperate to form a front caster assembly 88 which is rotatable about the axis of the shaft 76. Further, because the shaft 76 drives the pinion gear 78 and the crown gear 80, which are mounted in the rotatable caster housing 86, the drive assembly 66 is operative for either rotating the drive wheels 84 with the axle 82, rotating the entire caster assembly 88 about the axis of the drive shaft 76, or rotating both the drive wheels 84 and the caster assembly 88, depending on the relative amounts of resistance applied to the rotation of the caster assembly 88 and the wheels 84. As a result, the caster assembly 88, which functions as a front wheel drive assembly for the character figure assembly 20, is operative for moving the character figure assembly 20 on the surface of the game board 12, and it is adapted so that when the character figure assembly 20 engages the wall assembly 14 so that the frictional resistance between the wheels 84 and the game board 12 causes the wheels 84 to stop rotating, the entire caster assembly 88 is rotated about the axis of the shaft 76 so that the character figure assembly 20 is redirected on the game board 12 until the wheels 84 are once again free to move the character figure assembly 20 in a different direction.

The drive assembly 66 also includes a battery power supply 90 which powers the drive motor 68 through a switch assembly generally indicated at 92. The switch assembly 92 includes a rear wheel mounting fork 94 having a pair of rear wheels 96 thereon which support the rear portion of the character figure assembly 20. The rear wheel mounting fork 94 is downwardly biased by means of a spring 98, although it is upwardly movable slightly against the force of the spring 98 to cause a contact shaft 100 which extends upwardly from the rear wheel fork 94 to be moved upwardly so that a movable contact element 101 thereon is moved into engagement with a contact arm 102. The spring 98 is adapted so that the weight of the action character figure assembly 20 normally causes the moveable contact 101 on the contact shaft 100 to be maintained in engagement with the contacts arm 102. However, when the character figure assembly 20 is lifted off a supporting surface, the spring 98 moves the contact shaft 100 downwardly so that the moveable contact 101 is moved into a spaced disengaged position relative to the contact arm 102.

The movable contact 101 and the contact arm 102 are connected in series between one terminal of the battery power supply 90 and one terminal of the drive motor 68 through an actuator contact 104. The actuator contact 104 is engageable by a cam element 106 on the uppermost gear in the gear assembly 66 for maintaining the actuator contact 104 in engagement with the contact arm 102. However, the actuator contact 104 is movable off the cam 106 to allow the actuator contact 104 to be moved into a disengaged position relative to the contact arm 92. As a result, the actuator contact 104 and the cam 106 cooperate to provide a timer mechanism in which the cam 106 maintains the contact 104 in engagement with the contact arm 102 for a predetermined time period as defined by the rotation of the cam 106 in the gear assembly 66. Also included in the drive assembly 66 is an actuator button 108 which is normally biased to an upward position with a spring 110. The actuator button 108 includes a base portion 112 which is engageable with the contact arm 102 to move it downwardly to an engagement with the actuator contact 104 to initially actuate the drive assembly 66. Once the drive assembly 66 has been momentarily actuated in this manner, the cam 106 is moved into engagement with the actuator contact 104 to retain the actuator contact 104 in engagement with the contact arm 102 for a predetermined time period until the cam 106 allows the actuator contact 104 to move downwardly away from the contact arm 102. As a result, the drive assembly 66 is manually actuatable for a predetermined time period by depressing the actuator button 108. However, if the action character FIG. 20 is removed from a supporting surface so that the movable contact 101 is moved downwardly away from the contact arm 102, the operation of the drive assembly 66 is interrupted until the action character figure assembly 20 is again repositioned on a supporting surface.

Accordingly, for use in operation of the game apparatus 10, the target assemblies 16 are initially placed on the posts 32 within the area defined by the dog house element 46. Game players then take tums at rolling the dice 18 to determine the number of pickets 30 on the fence assembly 14 that their respective pawns or target elements 16 can be advanced in a clockwise direction. In this regard, in the event that both of the dice 18 land so that numbered surfaces thereon face upwardly, a game player is entitled to advance his or her target elements in accordance with the sum of the upwardly facing numbers. However, if the dice 18 land so that one numbered surface and one surface having a dog face thereon face upwardly, the game player is entitled to move his or her target element by a number of pickets 30 corresponding to the single numbered surface, and that game player must then activate the action character FIG. 20 on the game board 12. As a third alternative, if both dice 18 land so that sides having dog images thereon face upwardly, the player is not entitled to move his or her target element 16 and the action character FIG. 20 must be immediately actuated. In any event, once the action character figure assembly 20 has been actuated, it randomly moves about on the game board 12. Further, when the action character figure assembly 20 engages the fence assembly 14, the caster assembly 88 causes the action character figure assembly 20 to be redirected away from the fence assembly 14 so that the character figure assembly 20 is free to continue its random movement on the board 12. In the event that the action character figure assembly 20 comes in contact with one of the target arms 54 of a target element 16, the target arm 54 is pivoted inwardly causing the corresponding ejectable element 58 to be ejected upwardly from the fence assembly 14. The corresponding player must then reassemble his or her target assembly and reposition it on the fence assembly 14 in accordance with game rules. It should also be noted that the can elements 34 define safe spaces on the fence assembly 14 which protect 'the target arm 54 of a target assembly 16 from being actuated, and that, therefore, the spaces corresponding to the can elements 34 represent safe spaces which are randomly encountered during the course of game play.

It is seen, therefore, that the instant invention provides an effective action character figure assembly. The action character figure assembly 20 is randomly movable on the game board 12 for ejecting the ejectable elements 58 during the course of game play. Accordingly, the character figure assembly 20 and the target elements 16 cooperate to provide a highly exciting game format, and the game apparatus 10 has both a high level of amusement value and significant commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A game apparatus comprising:

a game surface;

fence means extending around said game surface;

a movable character figure receivable on said game surface within said fence means, said character figure being independently randomly moveable on said game surface in a manner causing said character figure to repetitively randomly engage different portions of said fence means; and target means on said fence means engageable by said character figure for producing a predetermihed action movement.

2. In the game apparatus of claim 1, said target means including an ejectable component which is ejected from said fence means in response to engagement of said target means by said character figure.

3. In the game apparatus of claim 2, said target means including spring means releasably securable in a loaded position for ejecting said ejectable component.

4. In the game apparatus of claim 1, said character figure including a pivotable caster assembly for supporting one end of said character figure.

5. In the game apparatus of claim 4, said character figure further including drive means for propelling said character figure on a supporting surface, said caster assembly including at least one drive wheel which is driven by said drive means for driving said character figure.

6. In the game apparatus of claim 5, said caster assembly being pivotable about a substantially vertical axis.

7. In the game apparatus of claim 1, said character figure including at least one rear wheel, at least two front wheels, a drive assembly, and a front caster assembly which is rotatable about a substantially vertical axis, said front wheels being mounted on said caster assembly and being driven by said drive assembly for moving said character figure on said game surface.

8. In the game apparatus of claim 7, said caster assembly being rotatable by said drive assembly.

9. In the game apparatus of claim 8, said caster assembly and said front wheels being rotatably driven by a common drive shaft to permit rotation of just said front wheels, rotation of just said caster assembly, or rotation of both said front wheels and said caster assembly, depending on the relative resistance to rotation applied to said caster assembly and said front wheels.

* * * * *